US011583749B2

(12) United States Patent
Leclerc

(10) Patent No.: US 11,583,749 B2
(45) Date of Patent: Feb. 21, 2023

(54) MODULAR FREE WEIGHT RACK

(71) Applicant: Marc Leclerc, Comox (CA)

(72) Inventor: Marc Leclerc, Comox (CA)

( * ) Notice: Subject to any disclaimer, the term of this patent is extended or adjusted under 35 U.S.C. 154(b) by 65 days.

(21) Appl. No.: 17/190,666

(22) Filed: Mar. 3, 2021

(65) Prior Publication Data

US 2021/0275891 A1 Sep. 9, 2021

Related U.S. Application Data

(60) Provisional application No. 63/053,398, filed on Jul. 17, 2020, provisional application No. 62/985,787, filed on Mar. 5, 2020.

(51) Int. Cl.
*A63B 71/00* (2006.01)
*A63B 21/072* (2006.01)

(52) U.S. Cl.
CPC ..... *A63B 71/0036* (2013.01); *A63B 21/0726* (2013.01)

(58) Field of Classification Search
CPC ..... A63B 21/0728; A63B 21/075
See application file for complete search history.

(56) References Cited

U.S. PATENT DOCUMENTS 4,848,855 A * 7/1989 Cone ..... A47B 67/04 248/309.2
5,616,108 A * 4/1997 Hayden ..... A63B 21/4029 482/104
5,697,870 A * 12/1997 Osborn ..... A63B 71/0036 482/52
5,924,964 A 7/1999 Hayden
5,954,619 A 9/1999 Petrone
D415,223 S 10/1999 Gay
6,123,651 A * 9/2000 Ellenburg ..... A63B 71/0036 482/104
6,524,355 B1 * 2/2003 Jenkins ..... A63B 23/0458 601/24
7,070,547 B1 7/2006 Pater
7,097,241 B2 * 8/2006 Tally ..... B25H 5/00 297/118
7,534,198 B1 5/2009 Strong
7,637,852 B2 * 12/2009 Hoole ..... A63B 21/0724 482/104

(Continued)

FOREIGN PATENT DOCUMENTS

WO 2016137428 9/2016

OTHER PUBLICATIONS

Watson Gym Co., https://watsongym.co.uk/product-category/accessories-and-other/. 6 pages.

(Continued)

*Primary Examiner* — Nyca T Nguyen
(74) *Attorney, Agent, or Firm* — Fish IP Law, LLP

(57) ABSTRACT

The presently claimed invention contemplates a weight rack system comprising a weight rack having a flexible, resilient weight platform configured to receive a weight, a first side wall configured to elevate the weight platform above a surface, a second side wall configured to elevate the weight platform above a surface. The weight platform includes a bump that helps guide a weight being placed onto the platform.

6 Claims, 12 Drawing Sheets

(56) References Cited

U.S. PATENT DOCUMENTS

| | | | | |
|---|---|---|---|---|
| 7,674,208 | B2 * | 3/2010 | Hoole | A63B 21/0724 482/104 |
| 7,922,624 | B1 * | 4/2011 | Fairhurst | A63B 21/0552 482/52 |
| 9,108,086 | B1 * | 8/2015 | Week | A63B 21/072 |
| 9,884,239 | B2 | 2/2018 | Kay | |
| D837,560 | S | 1/2019 | Hendricks | |
| 10,293,234 | B1 * | 5/2019 | Schlegel | A63B 69/345 |
| 10,843,027 | B2 * | 11/2020 | Wang | A63B 21/075 |
| 2002/0177509 | A1 * | 11/2002 | Rodgers | A63B 23/0458 482/53 |
| 2002/0190177 | A1 | 12/2002 | Nielsen | |
| 2003/0100406 | A1 * | 5/2003 | Millington | A63B 71/0036 482/106 |
| 2003/0199375 | A1 * | 10/2003 | Edwards | A63B 21/4035 482/141 |
| 2006/0205573 | A1 * | 9/2006 | Savage | A63B 71/0036 482/104 |
| 2010/0184570 | A1 * | 7/2010 | Cheng | A63B 21/0728 482/94 |
| 2012/0157271 | A1 | 6/2012 | Bauer | |
| 2012/0295774 | A1 * | 11/2012 | Dalebout | A63B 21/00058 482/106 |
| 2012/0309597 | A1 * | 12/2012 | Liu | A63B 21/075 482/107 |
| 2015/0087485 | A1 * | 3/2015 | Kimura | A63B 17/00 482/104 |
| 2016/0263459 | A1 * | 9/2016 | Hillson | A63B 21/06 |
| 2017/0120131 | A1 * | 5/2017 | Hedberg | A63B 21/078 |
| 2017/0239511 | A1 * | 8/2017 | Svenberg | A63B 21/075 |
| 2018/0078810 | A1 * | 3/2018 | Chen | A63B 71/0036 |
| 2020/0306578 | A1 * | 10/2020 | Pohl | A63B 21/078 |
| 2021/0146186 | A1 * | 5/2021 | Chen | A63B 21/075 |
| 2021/0154519 | A1 * | 5/2021 | Chen | A63B 21/078 |

OTHER PUBLICATIONS

FINNLO by Hammer, www.hammer-fitness.ch/ch-fr/finnlo-smartlock-hantel-set.html. 5 pages.
Body-Solid Power Rack GPR378, http://www.minktraining.com/product-category/. 5 pages.
The 5 Best Dumbbell Racks for Home Gyms, https://theworkoutdigest.com/best-dumbbell-racks/. 15 pages.
Mirafit Kettlebellset & Weight Rack, https://mirafit.co.uk/mirafit-kettlebell-set-weight-rack.html. 4 pages.
¾ Layer A Frame Steel Dumbbell Rack, https://www.aliexpress.com/item/4001111486307.html. 5 pages.
Compact Dumbbell Rack, https://www.aliexpress.com/i/4000549659054.html. 4 pages.
Watson Gym Co., https://watsongym.co.uk/product/dumbbell-stands/, Sep. 18, 2020.
FINNLO by Hammer, www.hammer-fitness.ch/ch-fr/finnlo-smartlock-hantel-set.html. 5 pages, Jul. 21, 2019.
Body-Solid Power Rack GPR378, http://www.minktraining.com/product/body-solid-power-rack-gpr378-package-with-bench-300-lb-weight-set, 5 pages, Sep. 18, 2020.
The 5 Best Dumbbell Racks for Home Gyms, https://theworkoutdigest.com/best-dumbbell-racks/. 15 pages, Aug. 13, 2020.
Mirafit Kettlebellset & Weight Rack, https://mirafit.co.uk/mirafit-kettlebell-set-weight-rack.html. 4 pages, Mar. 2, 2021.
¾ Layer A Frame Steel Dumbbell Rack, https://www.aliexpress.com/item/4001111486307.html. 5 pages, Mar. 2, 2021.
Compact Dumbbell Rack, https://www.aliexpress.com/i/4000549659054.html. 4 pages, Mar. 2, 2021.

* cited by examiner

MODULAR FREE WEIGHT RACK

This application claims priority to U.S. provisional application 62/985,787, filed Mar. 5, 2020 and to U.S. provisional application 63/053,398, filed Jul. 17, 2020. U.S. provisional applications 62/985,787 and 63/053,398 and all other extrinsic references contained herein are incorporated by reference in their entirety.

FIELD OF THE INVENTION

The field of the invention is fitness equipment.

BACKGROUND

The background description includes information that may be useful in understanding the present invention. It is not an admission that any of the information provided herein is prior art or relevant to the presently claimed invention, or that any publication specifically or implicitly referenced is prior art.

Free-weight training is a popular approach to strength and muscle development. Some of the most effective exercises using barbells involve a user lying on a bench or inclined bench. These exercises tend to be more effective than using a bench machine because they require a user to exert physical effort as well as control from the moment the weights are picked up until the rep is over and the weights are placed down.

Gyms often devote entire sections to these types of weights. However, existing benches do not provide an adequate place for placement of dumbbells in between sets. Most benches do not have any place to put dumbbells in between sets, which requires a user to place these weights on the floor. This increases the risk of injury because it requires a fatigued user to extend beyond the normal range of the exercise and flexibility to safely lower the weights. It also increases the chances a weight will be dropped by a fatigued user to avoid injuries.

Other racking solutions are large, heavy, cumbersome and do not offer versatility in arrangement and movement.

Thus, there is a need for a versatile free weight racking solution that assists a user in safely and easily securing free weights in between exercise sets.

These and all other extrinsic materials discussed herein are incorporated by reference in their entirety. Where a definition or use of a term in an incorporated reference is inconsistent or contrary to the definition of that term provided herein, the definition of that term provided herein applies and the definition of that term in the reference does not apply.

SUMMARY OF THE INVENTION

The inventive subject matter contemplates a system comprising a weight rack comprising a weight platform configured to receive a weight such as a dumbbell. The weight platform has an upwardly concave shape and is supported by side walls coupled to the weight platform at first and second ends. The weight platform is made from a semi-flexible material such that when a weight is placed onto the weight platform, it will cause the weight platform to bend further downward. This bend helps to better cradle the dumbbell.

In embodiments of the inventive subject matter, the weight platform includes an upwardly convex bump disposed at a midpoint of the weight platform. The bump's shape helps guide a dumbbell into proper position when being deposited onto the weight platform.

In embodiments of the inventive subject matter, the lower end of each of the side walls include a surface portion that is extended outwardly from the surface of the side wall. The shape and dimension of the outwardly-extended portion is such that, when the racks are rotated 90 degrees relative to each other, it fits the upper part of another rack, allowing the racks to be stacked to customize the height at which the weight platform can receive a dumbbell.

In embodiments of the inventive subject matter, the system can include an incline surface accessory that can be attached to the rack to provide an inclined surface upon which a dumbbell can be placed. The incline surface accessory includes a stop at the lower end of the incline that secures the dumbbell in place.

In embodiments of the inventive subject matter, the system can include a support platform. The support platform can attach to the rack at the rack's lower attachment points and has a surface dimensioned to receive a round weight plate. The support platform provides additional rigidity to the rack structure and, with a weight plate, provides additional weight at a low position to increase stability during use or as a base for stacking.

Various objects, features, aspects and advantages of the inventive subject matter will become more apparent from the following detailed description of preferred embodiments, along with the accompanying drawing figures in which like numerals represent like components.

DETAILED DESCRIPTION

The following discussion provides example embodiments of the inventive subject matter. Although each embodiment represents a single combination of inventive elements, the inventive subject matter is considered to include all possible combinations of the disclosed elements. Thus if one embodiment comprises elements A, B, and C, and a second embodiment comprises elements B and D, then the inventive subject matter is also considered to include other remaining combinations of A, B, C, or D, even if not explicitly disclosed.

Also, as used herein, and unless the context dictates otherwise, the term "coupled to" is intended to include both direct coupling (in which two elements that are coupled to each other contact each other) and indirect coupling (in which at least one additional element is located between the two elements). Therefore, the terms "coupled to" and "coupled with" are used synonymously.

Figure 1:
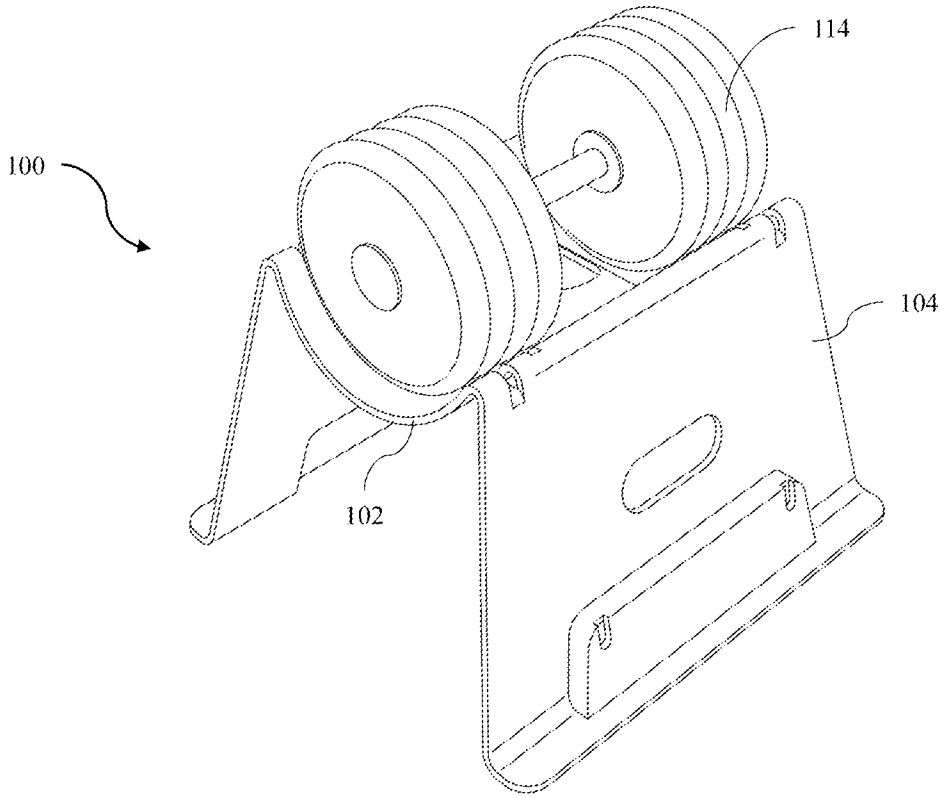
FIG. 1 depicts a perspective view of a weight rack, according to embodiments of the inventive subject matter.

FIG. 1 depicts a perspective view of a weight rack 100 with weight 114 resting on weight platform 102.

In the depicted embodiment, weight platform 102 is a concave structure with additional structural features. Weight platform 102 can be shaped and configured in any manner that allows weight platform 102 to receive weights. Weight platform 102 can also include any number of structural features. In the depicted embodiment, for example, weight platform 102 comprises a convex protrusion having an opening therein between the anterior and posterior edges of weight platform 102. It is contemplated that these structural features can serve any purpose, including for the purposes of improving the functioning of weight rack 100.

Weight rack 100 can comprise any one or more materials. For example, weight rack 100 can include a resilient polymeric material and a metal. In another example, weight rack 100 comprises only one material, such as a resilient polymeric material.

FIGS. 2A-2D depict various views of one embodiment of the weight rack and associated physical properties.

Figures 2A, 2B:
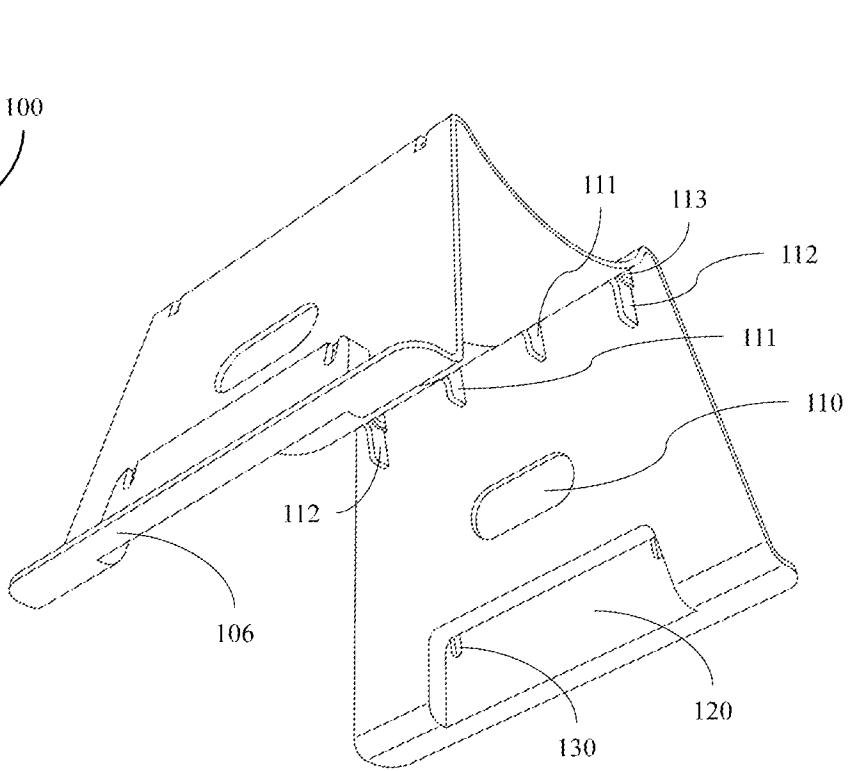
FIGS. 2A-2D depict various views of an embodiment of the weight rack and associated physical properties.

FIG. 2A depicts an angled top-down perspective of weight rack 100. FIG. 2B depicts an angled bottom up perspective of weight rack 100. Weight rack 100 comprises weight platform 102, side wall 104, base 106, bump 108, opening 110, and support structures 111 and 112.

In the depicted embodiment, weight platform 102 has an upwardly concave with bump 108 between the anterior and posterior edges of weight platform 102. However, weight platform 102 can be configured to receive any one or more weight shapes. In another embodiment, weight platform 102 can be modular, such that adding one or more accessories to weight platform 102 can convert the shape of the surface to a second surface. For example, weight platform 102 can receive an accessory adapted to mate at its inferior side with a concave top surface of weight platform 102. The top surface of the accessory can be configured in any way to accept any one or more types of weights.

In the depicted embodiment, side wall 104 is a support structure that elevates weight platform 102 from the ground. Side wall 104 meets weight platform 102 at both a first lateral side and a second lateral side of weight platform 102. Side wall 104 can also include one or more features such as opening 110, which can function as a handle to move weight rack 100.

In the depicted embodiment, side wall 104 terminates on its inferior side to base 106. However, base 106 can be any mechanism allowing weight platform 102 to contact and stay substantially fixed on a surface. In an alternative example, base 106 can be a set of legs directly attached to weight platform 102.

Base 106, as depicted, is shown as an outwardly flared extension of side wall 104 to create an inferior surface of weight rack 100 such that it can rest on top of a surface.

In the depicted embodiment, support structures 111 and 112 comprise multiple reinforcements to the joint created by weight platform 102 and side wall 104. It is contemplated that support structures 111 and 112 can provide additional structural support to handle the weight of exercise weights places on top of weight platform 102. As seen in FIG. 2B, the support structures 112 could be considered to be outer support structures and the support structures 111 could be considered to be inner support structures.

The rack 100 also includes extended surface portions 120 disposed near the bottoms of side walls 104. These surface portions 120 extend outwardly from the outside of the side walls 104, and have a corresponding cavity on the inside of the side walls 104 (as seen clearly in FIG. 2B). The carved surface portions 120 help to maintain the rack 100 stead when pins (such as lock pins) are inserted into the corresponding pin cavities 130.

As seen in FIG. 2A, the rack 100 includes a plurality of slots 140, which allow for the insertion of corresponding tabs to align the stacking and slots 141 for the installing of accessories on top of the rack 100.

Figure 2D:
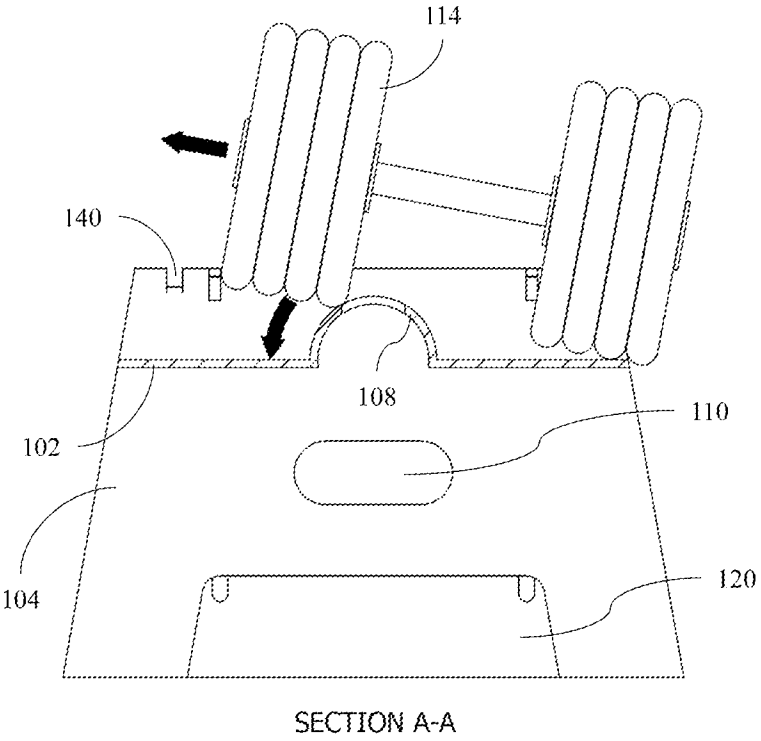
Figure 2C:
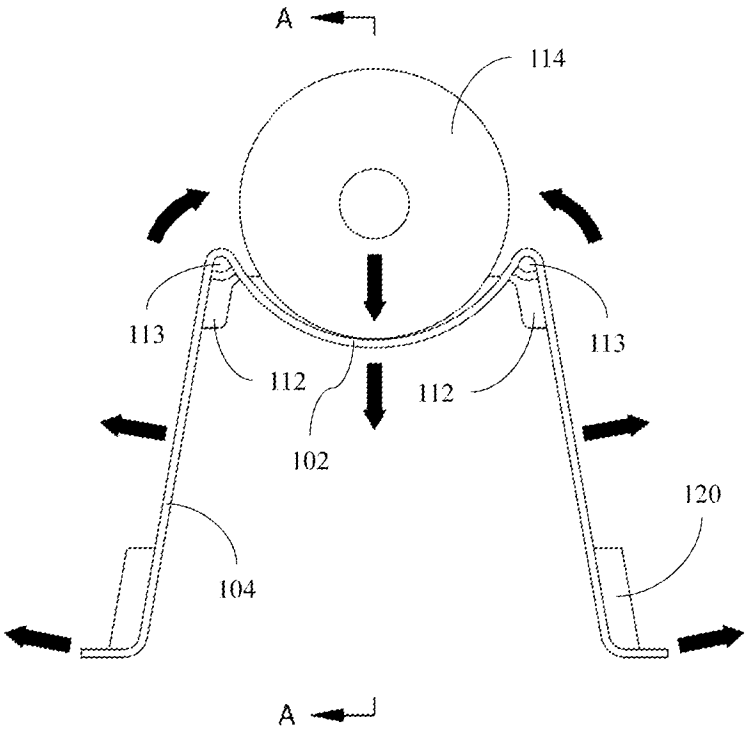

FIG. 2C depicts the distribution of downward force from the placement of a weight on top of weight platform 102 and the corresponding forces exerted on side wall 104 and base 106.

As seen in FIG. 2C, placing a barbell onto weight platform 102 will exert a downward force onto weight platform 102 (as indicated by the downward arrows). This force causes the weight platform to bend, causing the upper ends of the side walls 104 (at the point where the side walls 104 meet the weight platform 102) to displace inward (as illustrated by the curled arrows in FIG. 2C). This result in an outward force exerted on (and possibly, outward displacement of) the side walls 104 and base elements 106 as illustrated by the outward arrows.

The flexibility of the weight platform 102 provides the benefit of having a larger space to receive a dumbbell when the rack 100 is unloaded while also better cradling a dumbbell once it is placed onto weight platform 102. Thus, when a user becomes fatigued after performing an exercise, the larger spaced and curved surface of the weight platform 102 makes it easier to replace the dumbbell onto the rack 100. Additionally, the weight platform 102 can accommodate dumbbells of different diameters.

The weight platform 102 is made from a flexible, resilient material such that it stretches/bends downward when weight is placed on it and where it returns to the original position when the weight is removed. In embodiments of the subject matter, this resilience can provide an assist to a user that is removing the dumbbell.

As seen in FIG. 2B-2C, support structure 112 includes a hole or gap 113 dimensioned to fit pins (magnetic or lock pins) such that accessories or rack extensions can be attached to the rack 100.

FIG. 2D depicts the placement of weight 114 onto weight platform 102 of weight rack 100. As seen in FIG. 2D, the upward rounded cross-sectional shape of bump 108 acts as a guide for the weight 114 as it is placed onto the rack 100. Therefore, the weight 114 does not have to be placed perfectly onto the weight platform 102 to be successfully and safely racked.

The shape and size of bump 108 can vary depending on the intended application of the rack 100, to accommodate different types and weights of dumbbells. As seen in FIG. 2A, the bump 108 includes an opening 109 that accommodates a user's fingers when depositing or removing a dumbbell. This opening 109 can also serve as a handle for the rack 100 when the rack 100 is moved or a stacked.

Figure 3B:
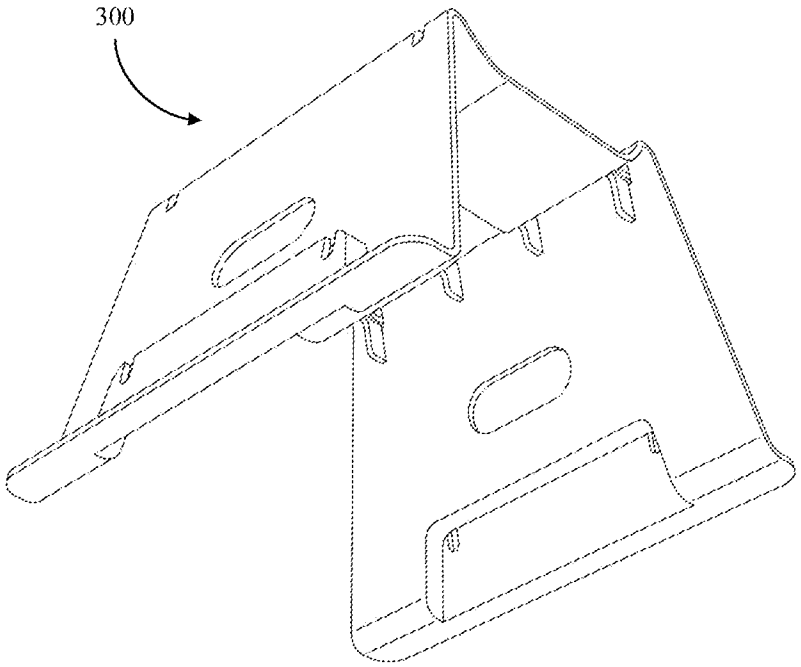
FIG. 3A-3B depict a weight rack with a flat top weight platform, according to embodiments of the inventive subject matter.
Figure 3A:
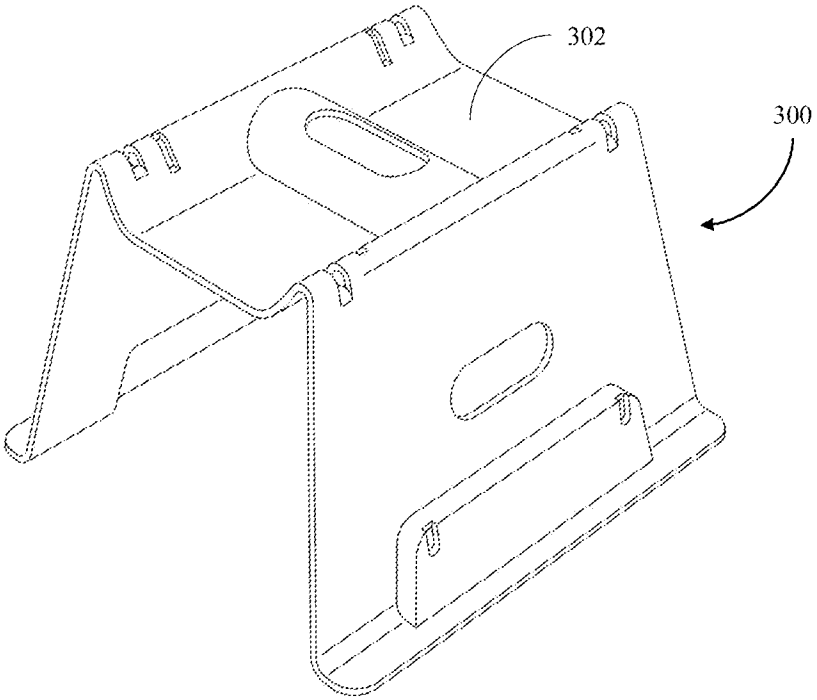

FIGS. 3A and 3B depict a rack 300 with a flat weight platform 302, according to embodiments of inventive subject matter. The flat weight platform 302 of FIGS. 3A-3B accommodates a flat-sided dumbbell, such as popular weight-adjustable dumbbells that have flat sides.

Figure 4B:
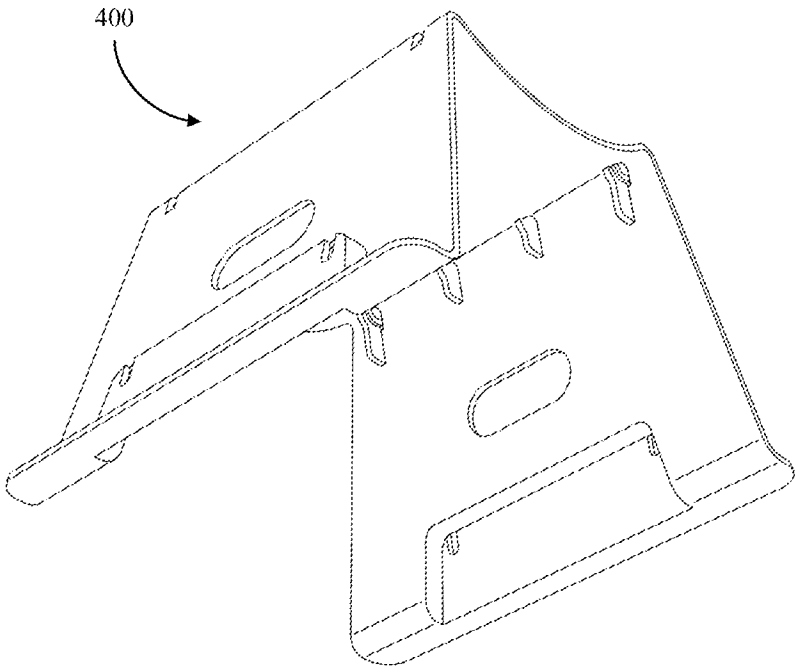
FIGS. 4A-4B depict a weight rack with a weight platform for use with barbells, according to embodiments of the inventive subject matter.
Figure 4A:
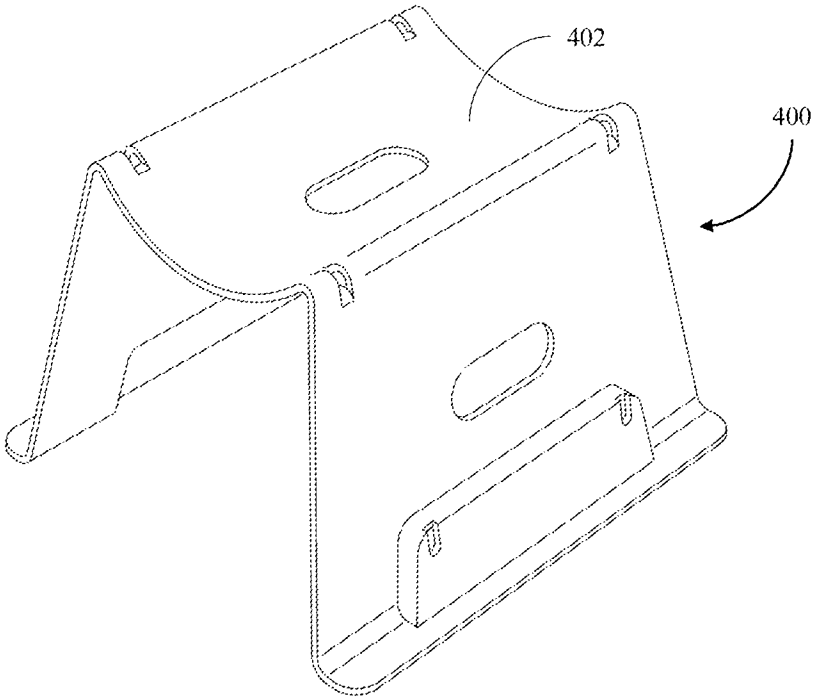

FIGS. 4A and 4B illustrate another embodiment of the inventive subject matter. FIGS. 4A-4B show a weight rack 400 for use with barbells. In these embodiments, the weight platform 402 does not contain a bump in the middle, and is thus capable of accommodating a barbell along the long axis of the rack 400.

Figure 5B:
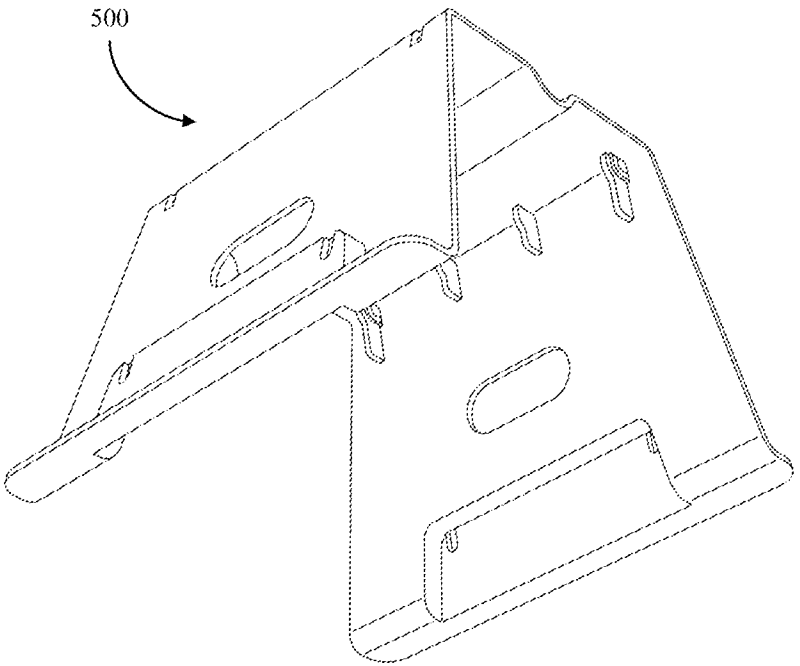
FIGS. 5A-5B depict a weight rack with a weight platform for use with kettle bells and other exercise equipment.
Figure 5A:
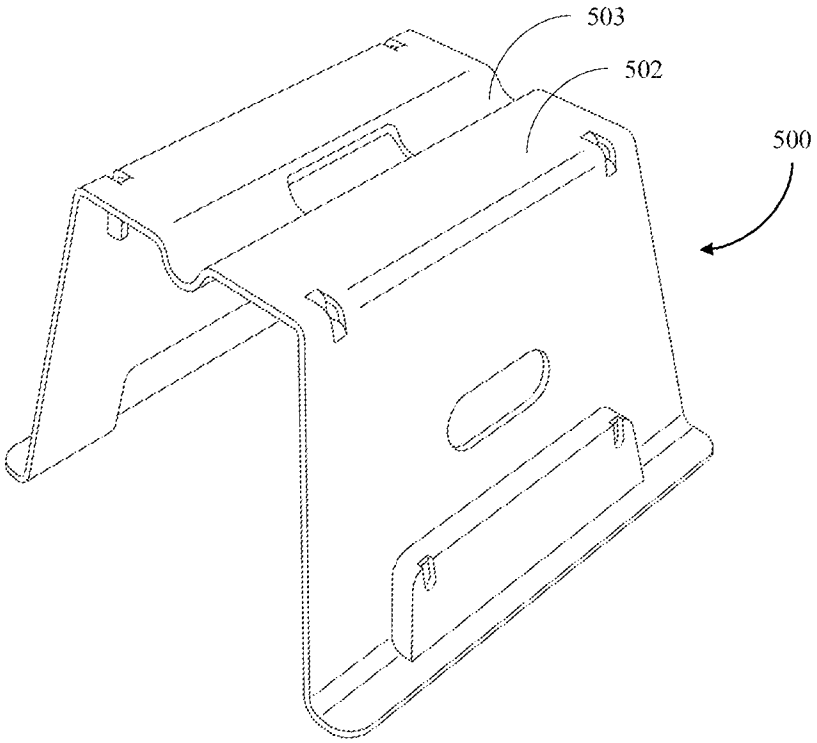

FIGS. 5A and 5B illustrate another embodiment of the inventive subject matter. FIGS. 5A-5B show a weight rack 500 having a flat weight platform 502 with a groove or channel 503 along the long axis of rack 500. The channel 503 accommodates kettle bells, bars, and other uses.

Figure 6:
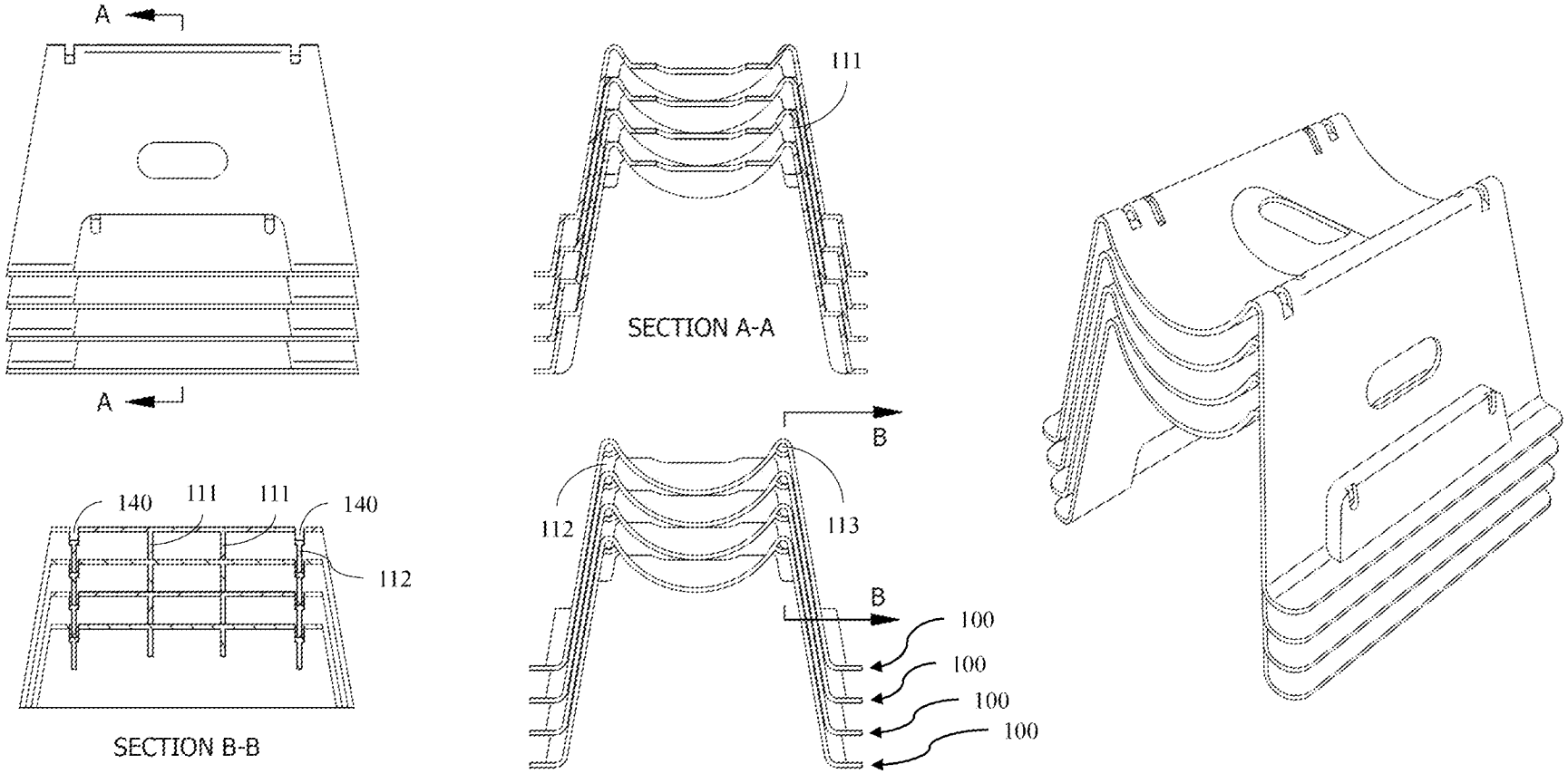
FIG. 6 depicts various views of a stack of weight racks, according to embodiments of the inventive subject matter.

FIG. 6 provides a side view, a perspective view and a section view of a stack of racks 100. As seen in FIG. 6 (and also FIG. 2C), each rack 100 has support structures 111 and 112 attached to the inside upper end of side walls 104. The support structures 111 and 112 acts as spacers that stabilize stacking, prevent squeezing and wobbling of the stack and allow the absorption and distribution of forces exerted upon the stack and of the individual members of the stack.

Figure 7:
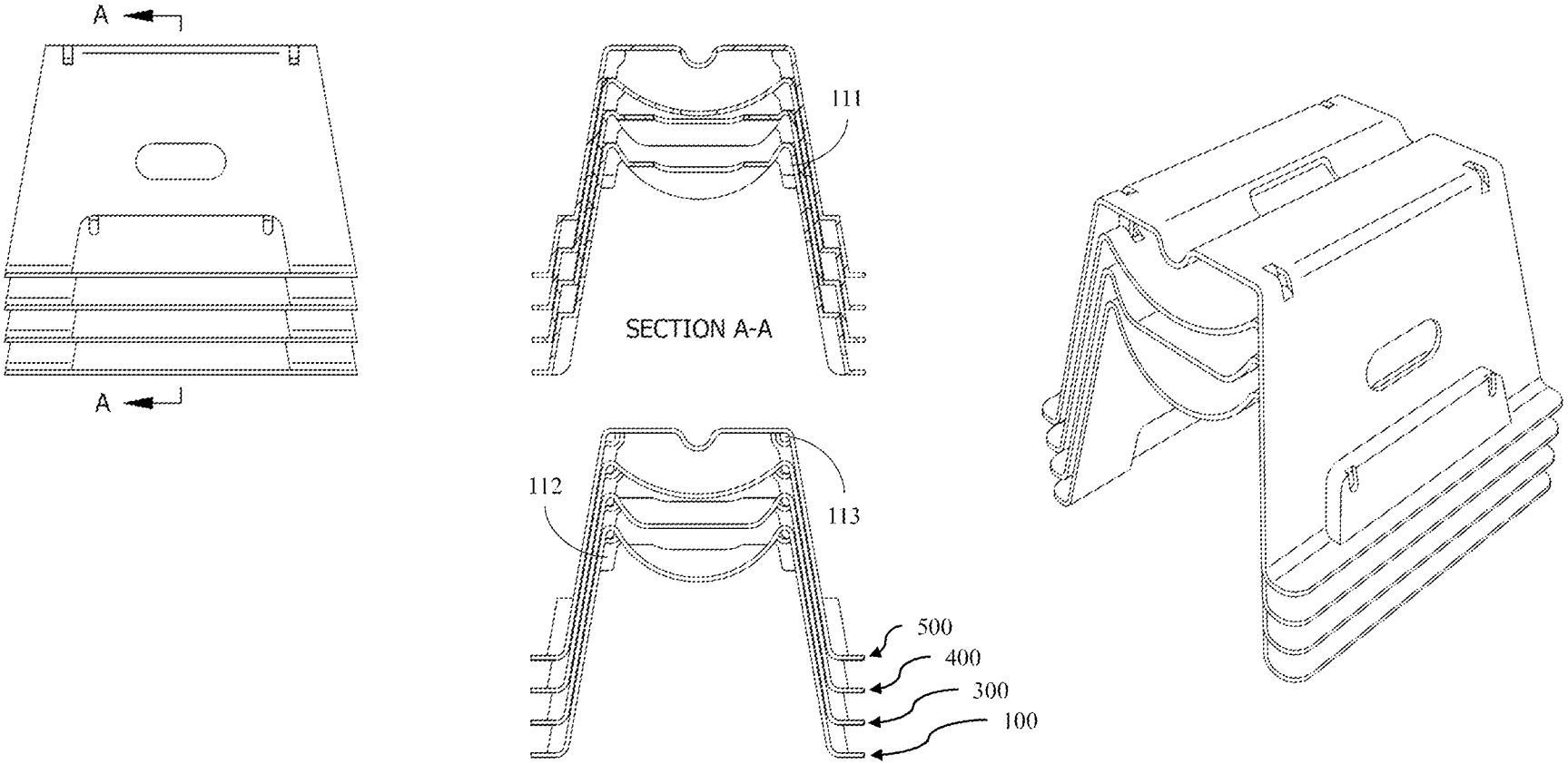
FIG. 7 shows how weight racks of the different embodiments can be stacked together.

FIG. 7 illustrates how the racks 100, 300, 400, 500 of the different embodiments of the inventive subject matter can be stacked together. The spacers enable the stacking of the different types of weight platforms of the different embodiments by providing sufficient clearance to accommodate the different shapes.

Figure 8:
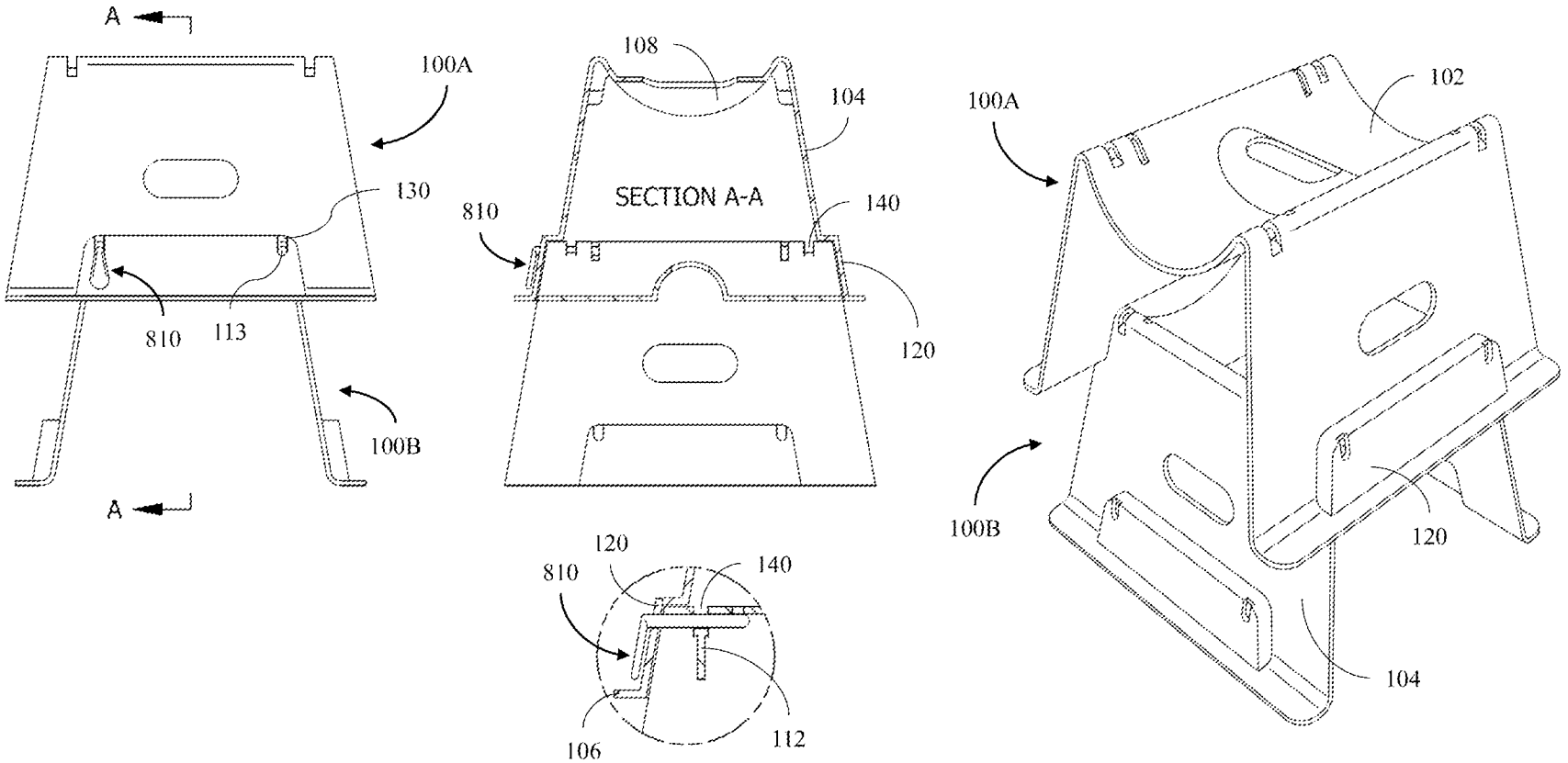
FIG. 8 provides multiple views showing a stacking of racks to adjust the height of the weight platform, according to embodiments of the inventive subject matter.

FIG. 8 shows a side view, a cutaway view and a perspective view of the stacking of a rack 100A onto another rack 100B such that exercise equipment can be rested at a greater height off the ground.

To securely stack racks 100A and 100B, pins 810 are used. In the embodiments shown herein, pins 810 are lock pins. As seen in FIG. 8, the inside cavity of extending surface portions 120 of rack 100A are dimensioned to correspond to the shape of the top of another rack 100B when the racks 100A and 100B are rotated 90 degrees relative to each other such that they can be stacked by fitting the top of the rack 100B into the cavity of outwardly-extending surface portions 120 of rack 100A. This stack results in the pin cavities 130 of rack 100A aligning with the gaps 113 of rack 100B. The pins 810 are then inserted through the aligned cavities 130, 113 to secure the stack. Pins 810 can be made of any suitable material and through any suitable process, such as metal, molded rubberized material, plastics, etc.

Thus, it will be appreciated that the racks can be stacked for storage if they are aligned with each other as in FIGS. 6 and 7, and stacked to change the height of the weight platform 102 as in FIG. 8 if they are offset by 90 degrees.

Figure 9:
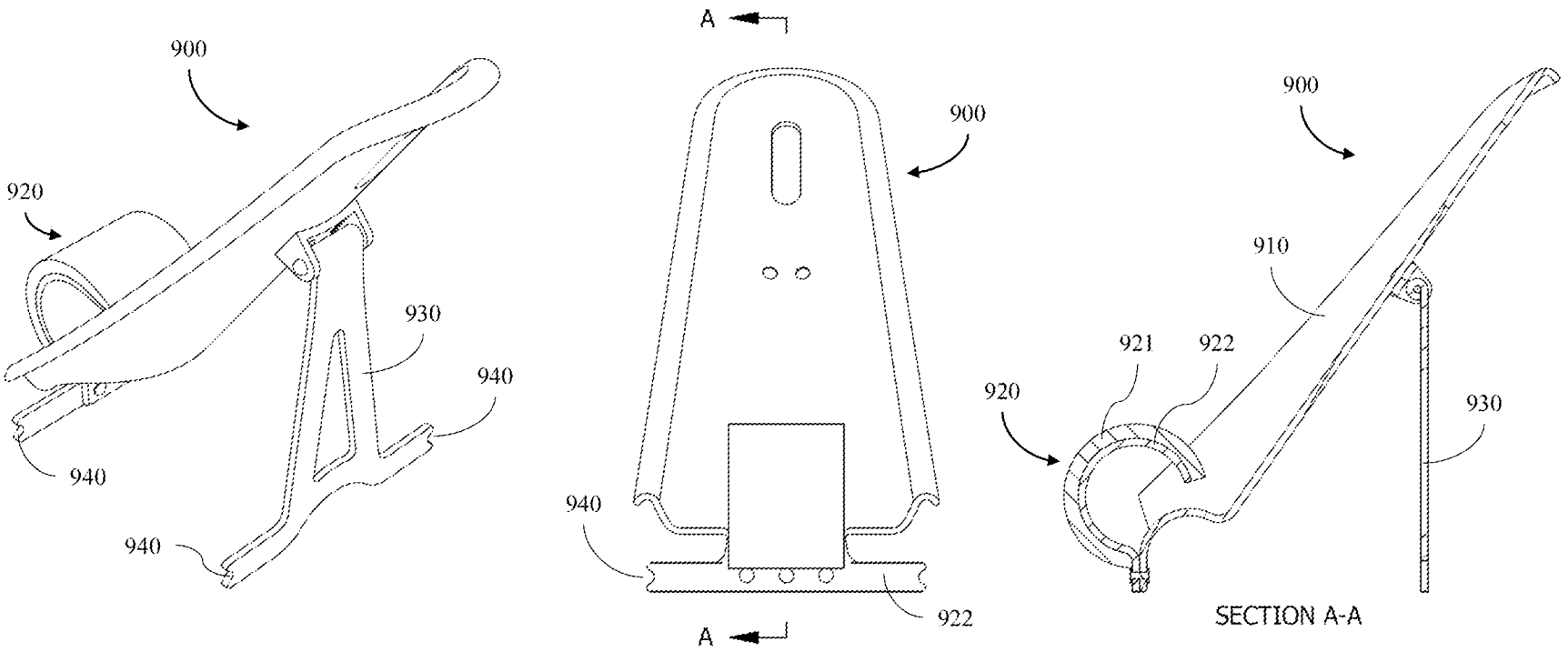
FIG. 9 shows an incline accessory that can be attached to the rack, according to embodiments of the inventive subject matter.

FIG. 9 illustrates an incline accessory 900 that can be attached to rack 100. This accessory includes an inclined surface 910 and a stop 920 that can be used to receive a dumbbell. The angled inclined surface 910 makes it easier to remove and replace the dumbbell for certain exercises (e.g., dumbbell presses, dumbbell flies, etc.), than a flat, horizontal surface. The stop 920 can include an outer rubber layer 921 disposed on an inner metal layer or other suitable material 922. The outer rubber layer 921 prevents slipping by the dumbbell and also provides an element of energy absorption when the dumbbell is placed onto the accessory 900. Accessory 900 also includes a support 930 that supports the inclination of the accessory 900 relative to the ground. The accessory 900 attaches to rack 100 via attachment points 940.

As seen in FIG. 9, the inner metal layer 922 is also used as a part of the base upon which the accessory 900 rests and is attached to at a front end to the rack 100. In other embodiments, this base can be separate from the inner metal layer 922.

Figure 10:
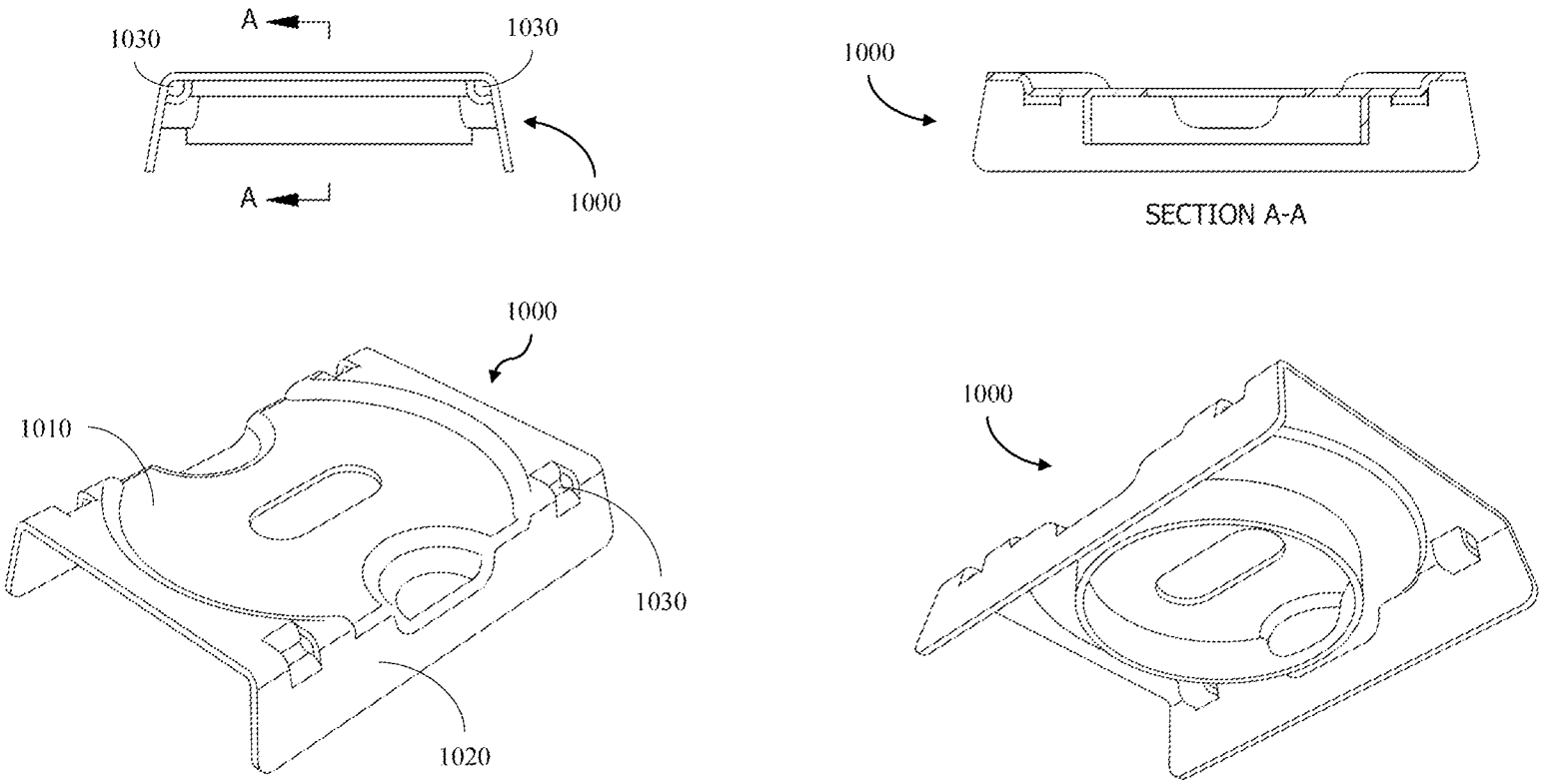
FIG. 10 shows a support stability platform accessory that can be attached to the rack, according to embodiments of the inventive subject matter.

FIG. 10 illustrates a stability platform 1000 that can be attached to rack 100 to add stability and rigidity to rack 100, according to embodiments of the inventive subject matter. Stability platform 1000 can be useful for situations such as when very heavy weights are used, when racks 100 are stacked, or with accessories such as accessory 900. The stability platform 1000 includes a round cavity 1010 that can accommodate circular weight plates to add additional weight and thus stability to the assembled rack 100 with the stability platform 1000. Stability platform includes pin openings 1030 used to attach the platform 1000 to rack 100. It should be noted that the stability platform can be attached to rack 100 or any of the other racks of other embodiments described herein.

The stability platform 1000 also has sidewalls 1020 that, when installed on a rack such as rack 100, will touch the ground providing additional stability via increased ground contact.

Figure 11:
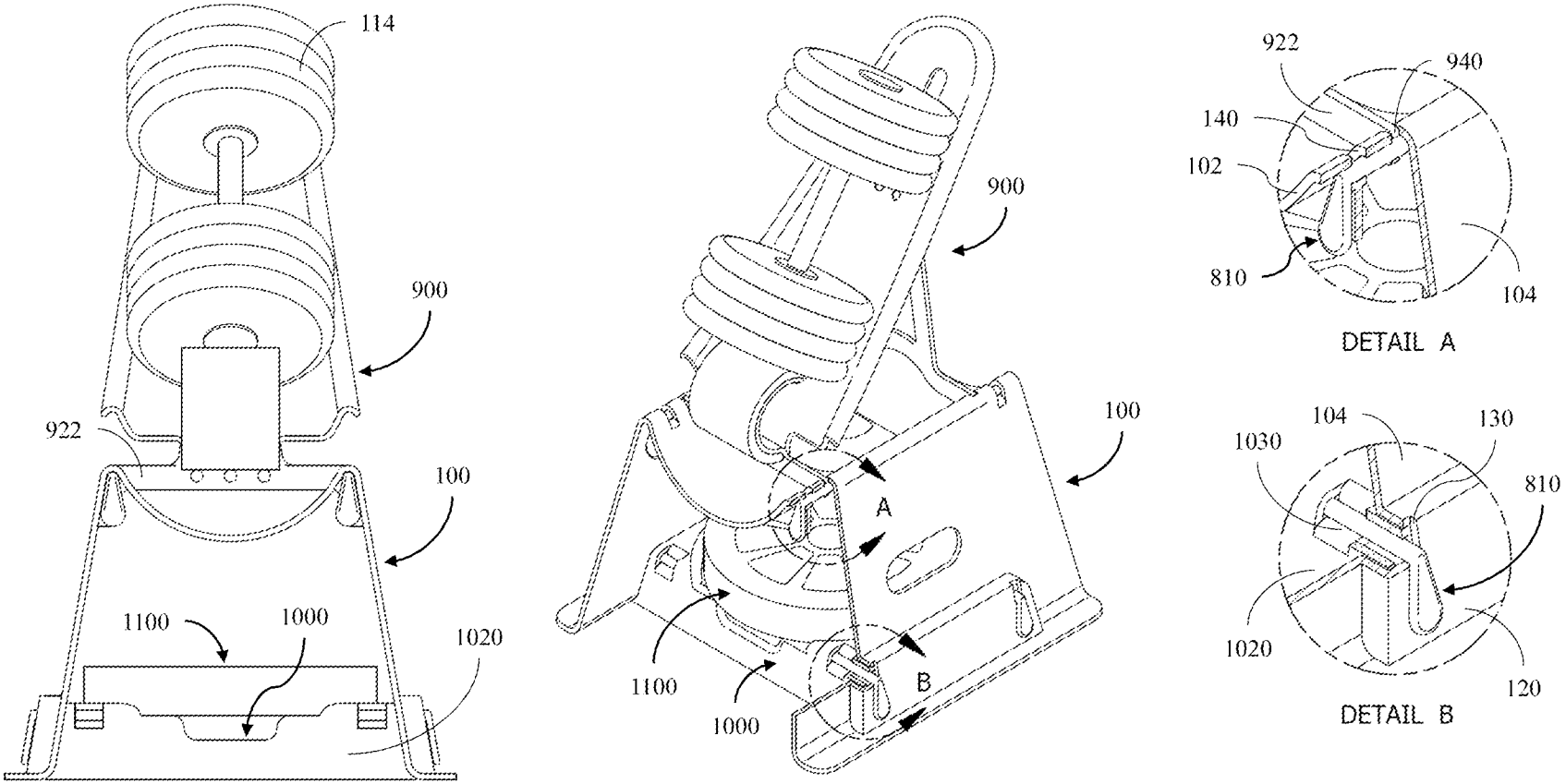
FIG. 11 shows front and isometric views of a rack with both the incline accessory and the stability platform attached.

FIG. 11 shows front and isometric views of a rack 100 with both the incline accessory 900 and the stability platform 1000 attached. As seen in FIG. 11, the incline accessory 900 has a dumbbell 114 and the stability platform has a weight plate 1100.

The isometric view in FIG. 11 shows a cutaway of a section of the side wall 102 that permits viewing of the entry of pins 810 into the cavities 113 and 130 of rack 100.

As seen in the cutaway labeled "Detail A", the incline accessory 900 is attached to the rack 100 by aligning the attachment points 940 with corresponding into opening 113 of the rack 100 and inserting pins 810.

As seen in the cutaway labeled "Detail B", the stability platform 1000 is attached to the rack 100 by aligning the pin openings 1030 of platform 1000 with openings 130 of rack 100, and inserting pins 810.

As used in the description herein and throughout the claims that follow, the meaning of "a," "an," and "the" includes plural reference unless the context clearly dictates otherwise. Also, as used in the description herein, the meaning of "in" includes "in" and "on" unless the context clearly dictates otherwise.

In some embodiments, the numbers expressing quantities of ingredients, properties such as concentration, reaction conditions, and so forth, used to describe and claim certain embodiments of the invention are to be understood as being modified in some instances by the term "about." Accordingly, in some embodiments, the numerical parameters set forth in the written description and attached claims are approximations that can vary depending upon the desired properties sought to be obtained by a particular embodiment. In some embodiments, the numerical parameters should be construed in light of the number of reported significant digits and by applying ordinary rounding techniques. Notwithstanding that the numerical ranges and parameters setting forth the broad scope of some embodiments of the invention are approximations, the numerical values set forth in the specific examples are reported as precisely as practicable. The numerical values presented in some embodiments of the invention may contain certain errors necessarily resulting from the standard deviation found in their respective testing measurements. Moreover, and unless the context dictates the contrary, all ranges set forth herein should be interpreted as being inclusive of their endpoints and open-ended ranges should be interpreted to include only commercially practical values. Similarly, all lists of values should be considered as inclusive of intermediate values unless the context indicates the contrary.

It should be apparent, however, to those skilled in the art that many more modifications besides those already described are possible without departing from the inventive concepts herein. The inventive subject matter, therefore, is not to be restricted except in the spirit of the disclosure. Moreover, in interpreting the disclosure all terms should be interpreted in the broadest possible manner consistent with the context. In particular the terms "comprises" and "comprising" should be interpreted as referring to the elements, components, or steps in a non-exclusive manner, indicating that the referenced elements, components, or steps can be present, or utilized, or combined with other elements, components, or steps that are not expressly referenced.

What is claimed is:

1. A system for mounting weights, comprising;

a rack comprising:

a curved weight platform dimensioned to receive an item of exercise equipment, the curved weight platform having an upward concave shape; and at least two side walls coupled to the weight platform;

wherein:

the curved weight platform has the upward concave shape starting from the at least two side walls; and the curved weight platform is made of a flexible, resilient material such that an inward force is exerted at a top of the at least two side walls when the item of exercise equipment is disposed on the curved weight platform;

each side wall having a section at the bottom of the respective side wall, the section having a surface that extends outwardly from the side wall and that is shaped to receive a cross-section shape of an upper section of a second rack when the rack is placed on top of the second rack and the second rack is angularly offset relative to the rack.

2. The system of claim 1, wherein the curved weight platform further comprises a bump extending upwardly from curved weight platform, the bump having a rounded shape that is perpendicular to the curvature of the curved weight platform.

3. The system of claim 1, further comprising:

an inclined surface accessory comprising:

an inclined support surface;

a stop disposed at a lower end of the inclined support surface;

at least one attachment opening disposed to align with a corresponding at least one upper attachment opening of the rack, and dimensioned to receive a lock pin.

4. The system of claim 1, further comprising:

a stability platform comprising:

a surface dimensioned to receive a weight plate; and at least one attachment opening disposed to align with a corresponding at least one lower attachment opening of the rack, and dimensioned to receive a lock pin.

5. The system of claim 1, wherein the outwardly disposed surface further includes an attachment opening disposed to align with a corresponding at least one upper attachment opening of the second rack, and dimensioned to receive a lock pin.

6. A system for mounting weights, comprising;

a rack comprising:

a curved weight platform dimensioned to receive an item of exercise equipment, the curved weight platform having an upward concave shape; and at least two side walls coupled to the weight platform;

wherein:

the curved weight platform has the upward concave shape starting from the at least two side walls; and the curved weight platform is made of a flexible, resilient material such that an inward force is exerted at a top of the at least two side walls when the item of exercise equipment is disposed on the curved weight platform; and an inclined surface accessory comprising:

an inclined support surface;

a stop disposed at a lower end of the inclined support surface; and at least one attachment opening disposed to align with a corresponding at least one upper attachment opening of the rack, and dimensioned to receive a lock pin.

* * * * *